United States Patent [19]

Adair

[11] 4,302,851

[45] Dec. 1, 1981

[54] HIGH TEMPERATURE PROTECTIVE MITT

[76] Inventor: Robin W. Adair, P.O. Drawer A, Avoca, N.Y. 14809

[21] Appl. No.: 153,831

[22] Filed: May 27, 1980

[51] Int. Cl.[3] ..... A41D 19/00

[52] U.S. Cl. ..... 2/158; 2/20; 2/167

[58] Field of Search ..... 2/158, 159, 161 A, 161 R, 2/164, 167, 16, 20

[56] References Cited

U.S. PATENT DOCUMENTS

| | | | |
|---|---|---|---|
| 237,524 | 2/1881 | Haight et al. | 2/158 |
| 1,571,860 | 2/1926 | Meyer | 2/164 X |
| 1,766,365 | 6/1930 | Weiss et al. | 2/158 X |
| 2,743,453 | 5/1956 | Singer | 2/158 |
| 2,889,556 | 6/1959 | Mehler | 2/158 |
| 2,905,946 | 9/1959 | Goldsmith | 2/158 |
| 2,966,684 | 1/1961 | Bonin | 2/158 X |
| 4,032,990 | 7/1977 | Mandlman | 2/20 X |
| 4,104,740 | 8/1978 | Rinehart | 2/158 |

*Primary Examiner*—Louis Rimrodt

*Attorney, Agent, or Firm*—Shlesinger, Fitzsimmons & Shlesinger

[57] ABSTRACT

This mitt, which is completely free of asbestos fibers, comprises hand and thumb sections, each of which is made from a wood knit liner enclosed in a layer of woven material made from temperature-resistant aromatic polymide fibers which are sold under the trademark "Kevlar". Layers of aluminum foil and flexible fiberglass are incorporated between the inner and outer layers of the hand section to increase its protective properties. Secured to the outer surface of each section is a pleated pad of flexible material woven from fiberglass yarns. Alternate pleats in each pad overlie intervening pleats, thereby forming spaced, parallel, raised surfaces which come into direct contact with the hot product handled by the person wearing the mitt. Flexible inserts in the form of fiberglass enclosed in aluminum foil may be inserted beneath the outer pleats for added protection; and additional layers of aluminum foil and fiberglass can be positioned between the pads and the outer surfaces of the respective thumb and hand sections to which they are secured.

14 Claims, 4 Drawing Figures

HIGH TEMPERATURE PROTECTIVE MITT

This invention relates to mitts or gloves for protecting the hands of individuals whose work requires the handling of extremely hot products, and more particularly it relates to an improved mitt of the type described which is reversible, and which does not utilize any asbestos.

Until recent years it had been commonplace to employ asbestos in the manufacture of heat-resistant protective mitts or gloves of the type worn by persons whose jobs require the handling of extremely hot products, for example, products whose surface temperatures exceed 400° C. At these exceptionally high temperatures it was found that other types of fiberous material tended to deteriorate rapidly, and in most cases seldom provided the protective heat shield afforded by the use of asbesto. Now, however, because of recent investigations suggesting the carcinogenous nature of asbestos fibers, most industries have begun either to ban the use of asbestos fibers in heat protective mitts, or at least have begun to phase out the use of such mitts.

Because of the above-noted cancer scare, numerous efforts have been made in recent years to produce a non-asbestos, heat-resistant mitt of the type described. Such efforts, however, heretofore have failed to produce a satisfactory mitt which would exhibit not only the necessary heat protection, but also abrasion resistance and satisfactory handling characteristics, as for example, enabling the wearer satisfactorily to grip and manipulate the particular products in question.

It is an object of this invention, therefore, to provide an improved protective mitt of the type described, which is manufactured from fabrics which do not utilize any asbestos fibers, and which nevertheless provide excellent heat protection, abrasion resistance, and handling characteristics.

Still another object of this invention is to provide a non-asbestos protective mitt of the type described which is made from a plurality of different fabrics that are assembled in such manner as to produce a mitt having corrugated or ribbed surfaces, which considerably enhance the combined heat-resistance, hand-protecting properties of the mitt.

Another object of this invention also is to provide a protective mitt of the type described which is manufactured so as to be completely reversible, in the sense that it can be used either on the right or the left hand of a person, and in either case will provide equal protection when used to handle extremely hot products.

Other objects of the invention will be apparent hereinafter from the specification and from the recital of the appended claims, particularly when read in conjunction with the accompanying drawings.

Figure 1:
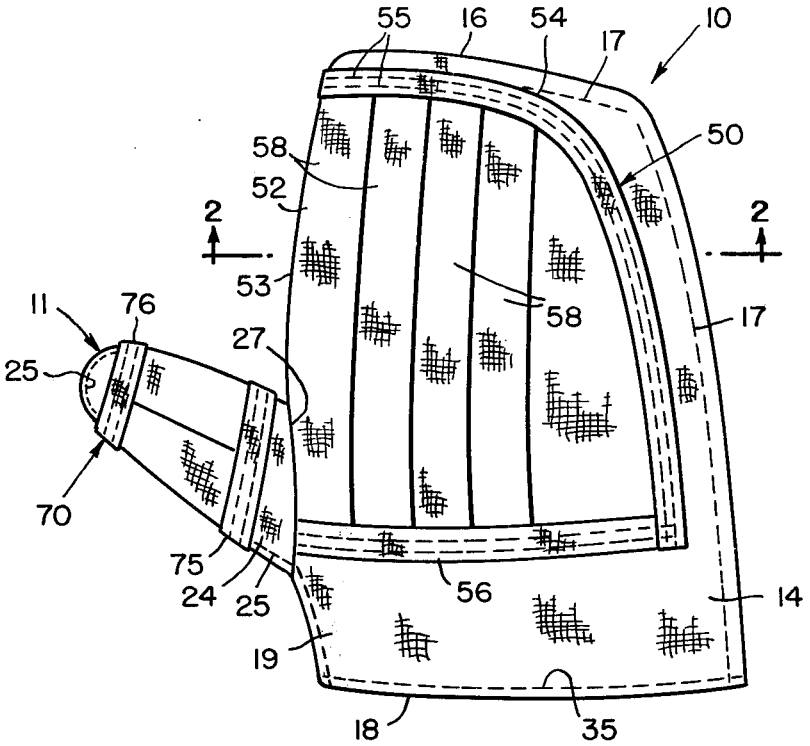
FIG. 1 is a front elevational view of a protective mitt made according to one embodiment of this invention.
Figure 3:
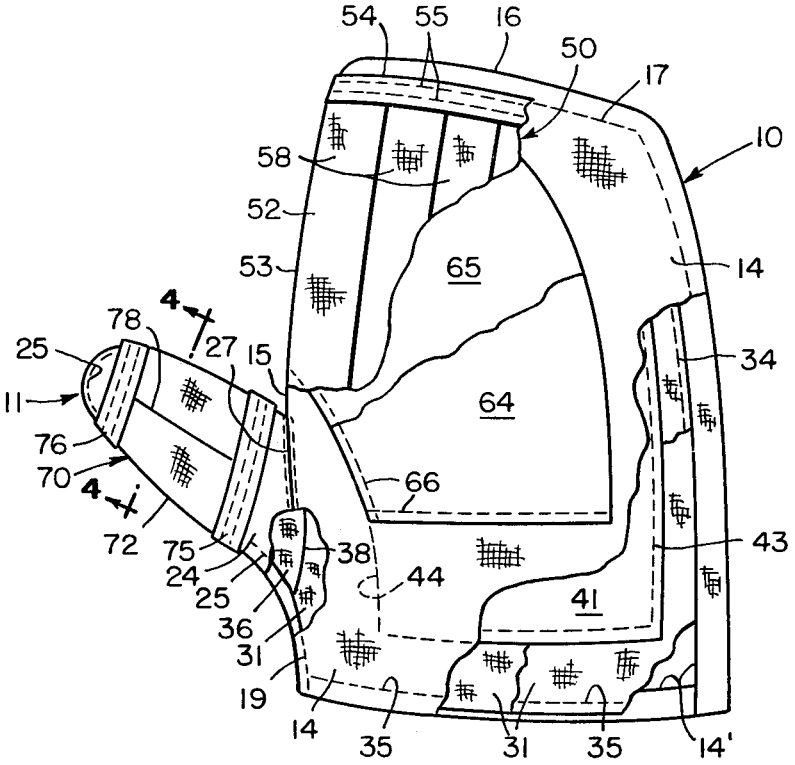
Figure 4:
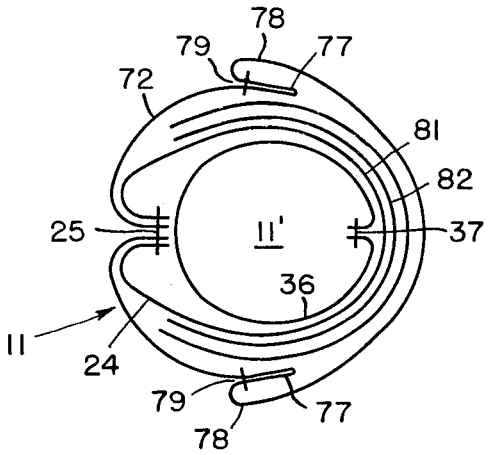

FIG. 3 is a front elevational view similar to FIG. 1, but with portions of the mitt cut away for purposes of illustration; and FIG. 4 is an enlarged sectional view taken generally along the line 4—4 in FIG. 3 looking in the direction of the arrows, and illustrating diagramatically the numerous layers of material that are employed in the thumb portion of the mitt, and the manner in which they are stitched together.

Figure 2:
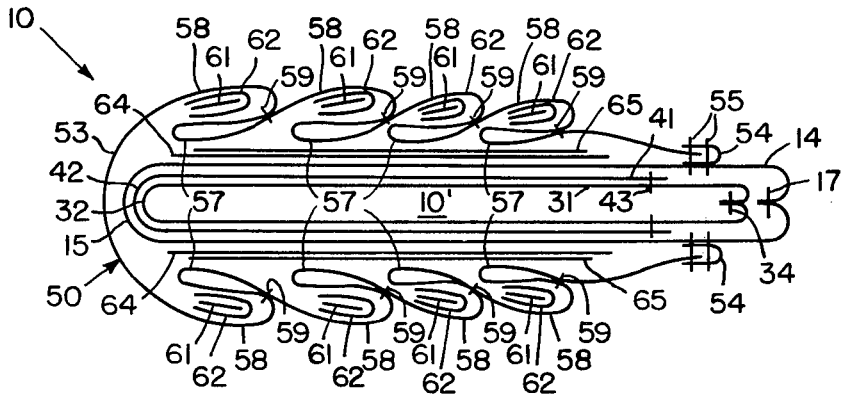
FIG. 2 is an enlarged, fragmentary sectional view taken generally along the line 2—2 in FIG. 1 looking in the direction of the arrows, and illustrating diagramatically the numerous layers of materials that are employed in this mitt, and the manner in which certain such layers are folded over and stitched together.

Referring now to the drawings by numerals of reference, 10 denotes generally the hand or finger and palm enclosing section of a protective mitt made according to this invention, and 11 denotes generally the thumb section thereof, which projects in the usual manner from the index finger side of section 10. Also as in the usual manner, the hand section 10 has therein a central opening 10' (FIG. 2) which communicates with the central opening 11' (FIG. 4) in the thumb section 11.

The main, outer layer 14 of the hand section 10 comprises a material woven from yarns made from aramid fibers of the type sold by E. I. du Pont de Nemours & Co. (Inc.) under the trademark "Kevlar". Layer 14 is folded intermediate its ends along a line 15 (FIGS. 2 and 3), which extends from the thumb section 11 forwardly toward the outer, closed end 16 of section 10. Overlapping, folded marginal edges 14' (FIG. 3) of layer 14 are stitched together as at 17 along a line extending continuously from a point adjacent the tip of the index finger area of the mitt, and around the outside of the mitt to one side of its open end 18 (FIG. 1). At the side of opening 18 remote from stitch line 17, and just below its fold line 15, the outer layer 14 has therein the usual thumb opening which is attached to the inner end of the thumb section 11 as noted hereinafter. Below its thumb opening layer 14 has registering marginal edges which are folded over and stitched together along the line 19 (FIGS. 1 and 3).

The thumb section 11 also comprises a main, outer layer 24, which is made from the same woven material ("Kevlar") as the layer 14. Layer 24 is folded into a generally tubular configuration (FIG. 4), and has overlapping marginal edges folded over and stitched together along a line 25 extending from the stitch line 19 outwardly and around the outer end of the tubular thumb section 11 to close the latter. The open, inner end of folded layer 24 registers with the thumb opening in section 10, and has marginal edge portions thereof stitched to marginal edge portions of layer 14 along a seam 27 which extends completely around the inner end of section 11.

The outer layer 14 of section 10 is completely lined with an inner layer 31 of wool knit fabric, which like the outer layer 14, is folded intermediate its ends along a fold line 32 (FIG. 2), which extends along the inside of fold line 15 forwardly from the thumb section 11 to a point adjacent the closed end 16 of outer layer 14. Also as in the case of outer layer 14, the inner layer 32 has its marginal edges stitched together along a line 34 (FIGS. 2 and 3) which is spaced just inwardly from the stitch line 17, and which extends across the outer end of the finger tip portion of the mitt, and rearwardly to the open end 18, thus closing the outer end of the liner. The liner, as represented by the folded layer 32, is not attached to the outer layer 14 except around the open end 18. In this area the open end of liner 32 is stitched against the outer layer 14 along a stitch line 35 (FIGS. 1 and 3) which extends completely around the open end 18 of the mitt.

Like the hand section 10, the thumb section 11 also has a generally tubular liner 36 (FIGS. 3 and 4) made from the same wool knit fabric as the hand section liner 31. Liner 36 is made from a fabric layer folded into a tubular configuration similar to that of the outer, thumb layer 24, but stitched along a line 37 (FIG. 4) opposite to that of the stitch line 25, thus affording the wearer more comfort. As in the case of the outer layer 24, the thumb liner is stitched closed at its outer end, and has its open, inner end stitched along a seam 38 (FIG. 3) to the hand section liner 31 around its thumb opening.

The aforedescribed inner layers or liners 31 and 36 are substantially coextensive with their respective outer layers 14 and 24, and in combination therewith are designed to cover substantially the entire hand of the person wearing the mitt 10, with the open end 18 of the latter surrounding the wrist of the wearer.

Interposed between the outer layer 14 and the inner knit layer 31 in the hand section 10 is a layer 41 (FIGS. 2 and 3) of wool felt. As in the case of layers 14 and 31, the felt layer 41 is folded intermediate its ends along a fold line 42 which is disposed between, and extends parallel to, the fold lines 15 and 32 of layers 14 and 31, respectively. Although the marginal edges of the registering portions of layer 41 extend parallel to the stitch lines 17 and 34, they are not stitched to each other, but instead each portion is stitched along a line 43 to the adjacent layer of the knit liner 31. The felt layer 41 also differs from the mitt layers 14 and 31 in that it does not extend completely around the thumb openings, but instead has an inner, curvilinear edge 44 (FIG. 3), which is spaced from and curved about the junction between the mitt sections 10 and 11, respectively.

Secured to and covering major portions of outer layer 14 of the mitt is a corrugated, or ribbed, insulating hand patch, which is denoted generally at 50. Patch 50 comprises a layer 52 of material which is woven from glass fibers, and which is generally similar in configuration to, but larger than, the felt layer 41 that is interposed between the inner and outer layers 31 and 14 of the mitt section 10. Layer 52 is folded intermediate its ends about a fold line 53 (FIGS. 1-3), which extends from the juncture of sections 10 and 11 outwardly toward the closed end 16 of the mitt. The curved, outer edge of layer 52 is enclosed in a similarly curved strip 54 of tape, also woven from glass fibers, and which is stitched both to the outer, curved edge of the layer 52 and to the outer layer 14 of mitt section 10 along curved stitch lines 55 which follow approximately the stitch line 17 for layer 14. The inner or lower edge of layer 52, as shown in FIG. 1, curves around the inner end of thumb section 11 and is stitched thereto along the same seam 27 as layers 24 and 14. This inner edge of layer 52 also has a portion at each side of the mitt section 10 which is enclosed within a further strip 56 of tape (similar to tape 54), and which extends between the seam 27 and the adjacent stitch line 17 generally parallel to the edge of the open end 18 of the mitt.

Intermediate its ends the glass layer 52 is folded back upon itself several times at spaced intervals, (four times at each side of the mitt section 10), and has the overlapping inner and outer folds 57 and 58, respectively, of each such folded section stitched together along a line 59 (FIG. 2) which extends generally parallel to the fingers of the wearer. As a result, the fabric layer 52 has at each side of the mitt section 10 a plurality (four in the embodiment illustrated) of spaced, outer folds or ribs 58, which give the hand patch 50 a corrugated appearance.

Mounted in the patch section 50 between each outer fold 58 and its associated inner fold 57 is an elongate insert in the form of a flexible, glass fiber core 61 (FIG. 2) enclosed, at least along three sides thereof, in a sheet 62 of aluminum foil. These inserts help to fluff up, or retain in an expanded condition, the several outer folds or ribs 58 which come into direct contact with the hot product handled by the wearer.

For even further protection an additional layer 64 (FIGS. 2 and 3) of flexible glass fibers, which is covered with a thin layer 65 of aluminum foil, or the like, is secured on the outer surface of the layer 14 beneath the hand patch section 50. As shown more clearly in FIG. 3, the layers 64 and 65 are generally similar in configuration to, but slightly smaller than, the layer 41 of wool felt; and they may be stitched as at 66 at least along their inner edges to layer 14.

The thumb section 11 of the mitt is also provided with added protection by enclosing most of its outer layer 24 in a ribbed or corrugated patch 70, which can be made in a manner similar to the patch 50. Patch 70, however, is made in a generally tubular configuration so that it can be secured completely around the outside of layer 24 for substantially the full length of the thumb section 11. As in the case of the patch section 50, section 70 comprises a woven glass fiber layer 72 which is folded into the configuration of a sleeve, and with its longitudinal side edges stitched together, as shown more clearly in FIG. 4, along the same seam 25 that is formed by the outer layer 24 of the thumb section. The edges of the glass layer 72 at opposite ends of its tubular configuration are enclosed in strips 75 and 76 of glass fiber tape, which are stitched to layer 72 and to the underlying layer 24 of the thumb section.

Intermediate its ends the glass layer 72 is folded back upon itself a plurality of times at spaced intervals (once at each side of the thumb section in the embodiment illustrated), thus forming at each side the thumb section overlapping inner and outer folds 77 and 78, respectively, which are stitched along lines 79 (FIG. 4) that extend parallel to the thumb section. As in the case of the hand section 10, a flexible glass fiber layer 81 together with a covering layer 82 of aluminum foil are interposed between the patch 70 and the main outer layer 24 of the thumb section. Moreover, although not illustrated in FIG. 4 it will be apparent that, if desired, an insert in the form of a strip of flexible glass fibers covered by aluminum foil can also be inserted beneath each outer fold 78 of the patch 70 in the same manner such inserts are employed in the patch 50.

From the foregoing, it will be apparent that the invention disclosed herein provides an exceptionally sturdy and reliable mitt for protecting operators from injury resulting from the handling of extremely hot products. By securing the ribbed or corrugated patches 50 and 70 to the mitt's hand and thumb sections 10 and 11, respectively, the hot products that are handled are prevented from coming into direct, planar contact with the outer surface of the mitt. In other words the pillowed or puffed-type ribs 58 and 78 permit air to circulate between the surface of the mitt and the hot product that is being handled, thus providing increased insulation and protection from the heat given off by the product. Moreover, since substantially the entire external surface of the mitt, at least in the operating areas of the hand and thumb, are made from glass fibers, the mitt not only has excellent heat resistant properties, but also presents excellent abrasion resistant surfaces to the hot products that are being handled. In this connection it is preferable that threads that are made from glass fibers be employed for securing together the various layers of material. Such threads resist deterioration under almost any operating conditions.

Another important feature in this mitt lies in the fact that it is possible to manufacture it without using any asbestos fiber, and yet the resulting product contains all the advantages, and more, than conventional mitts which employ asbestos fibers. When manufactured as disclosed herein, applicant's mitt not only is relatively light and suitable for use on either the right or the left hand, but also has excellent handling characteristics which enable the wearer readily to manipulate hot products without fear of accidentally dropping them.

The above-described "Kevlar" fiber is one member of a family of aromatic polyamide fibers which have been granted the generic name "aramid" by the Federal Trade Commission. The fiber has an extremely high tensile strength, has high toughness characteristics, and good thermal stability. It neither melts nor supports combustion under normal environmental conditions.

While this invention has been illustrated and described in connection with only one embodiment thereof, it will be apparent that it is capable of still further modifications, and that this application is intended to cover any such modifications that may fall within the scope of one skilled in the art, or the appended claims.

What I claim is:

1. A protective mitt for use when handling hot products, comprising an enclosed hand section having in one end a first opening for permitting the insertion of a person's hand into the hand section, and having a second opening therein through which a person's thumb may project, a generally tubular thumb section closed at its outer end, and connected around its inner end to said second opening in said hand section to enclose a thumb projecting from said second opening, each of said sections comprising an inner layer of fabric disposed to be in direct contact with a person's hand and thumb, respectively, and an outer layer of non-combustible fabric surrounding said inner layer, a first flexible pad secured to and overlying part of said thumb section intermediate its ends, and a second flexible pad secured to and overlying at least the side of said hand section which is disposed to register with and cover the palm of the person wearing the mitt, each of said pads being made from a non-combustible material, and having formed on the outside thereof a plurality of spaced, generally parallel, raised surfaces disposed to come into direct contact with the surface of a product that is being manipulated by the person wearing the mitt.

2. A protective mitt as defined in claim 1, wherein said second pad overlies both sides of said hand section, and said mitt is suitable for use on either the right or left hand of a person,

3. A protective mitt as defined in claim 2, wherein said raised surfaces on said first pad extend generally parallel to said thumb section, and the raised surfaces on said second pad extend generally parallel to the axis of said first opening in said hand section.

4. A protective mitt as defined in claim 3, wherein said outer layers of fabric are made from aromatic polymide fibers, and said pads are made from glass fibers.

5. A protective mitt as defined in claim 1, wherein each of said pads is made from a pleated fabric having a plurality of spaced outer folds defining said raised surfaces, and a plurality of spaced inner folds alternating with said outer folds, and extending between said outer folds and the outer layer of fabric of the section to which the pad is secured.

6. A protective mitt as defined in claim 5, including an elongate, flexible, fiberglass insert positioned beneath each outer fold of said second pad.

7. A protective mitt as defined in claim 5, including a flexible fiberglass layer secured to the outer layer of said hand section beneath said second pad, and a layer of wool felt secured between said inner and outer layers of said hand section to overlie both sides of the latter.

8. A protective mitt as defined in claim 7, including a layer of aluminum foil positioned between said second pad and said fiberglass layer.

9. A protective mitt as defined in claim 8, wherein said inner layer of each of said sections is made from a wool knit fabric, and said outer layer of each section is woven from an aromatic polymide fiber yarn.

10. A protective mitt for use in handling hot products, comprising a hand section for enclosing and protecting the fingers, the palm and the back of a person's hand, and a thumb section communicating with the interior of the hand section, and disposed to surround the thumb of the person wearing the mitt, and a pleated fabric secured to and overlying opposite sides, respectively, of each of said sections, and forming on each of said sections a plurality of spaced pleats, and means causing alternate pleats on each of said sections to be raised relative to the intervening pleats, whereby said alternate pleats define on each of said sections a plurality of spaced, raised surfaces which are disposed to come into direct contact with a hot product handled by the person wearing the mitt, said pleated fabric and said hand and thumb sections comprising fabrics made from heat-resistant, substantially non-combustible fibers.

11. A protective mitt as defined in claim 10, wherein said means comprises means securing said intervening pleats to one of said sections so that said intervening pleats extend beneath and help support said alternate pleats in their raised positions.

12. A protective mitt as defined in claim 11, including a plurality of heat insulating layers secured to said hand and thumb sections beneath said pleated fabric, one of said layers being aluminum foil and another thereof comprising flexible fiberglass.

13. A protective mitt as defined in claim 12, wherein an elongate, flexible, fiberglass insert is mounted beneath each of said alternate pleats and overlies the intervening pleat that extends beneath the last-named alternate pleat.

14. A protective mitt as defined in claim 13, wherein each of said sections comprises an outer, woven layer of material made from aromatic polymide fibers, and a wool knit liner therefor, said pleated fabric covers portions only of said hand and thumb sections of the mitt, and said mitt being completely of asbestos fibers in any form.

* * * * *